US011751673B1

(12) United States Patent
Panosian et al.

(10) Patent No.: US 11,751,673 B1
(45) Date of Patent: Sep. 12, 2023

(54) LOCKING SCREWDRIVER HOLDER

(71) Applicants: Michael H Panosian, Irvine, CA (US); Joshua M Keeler, Irvine, CA (US)

(72) Inventors: Michael H Panosian, Irvine, CA (US); Joshua M Keeler, Irvine, CA (US)

( * ) Notice: Subject to any disclaimer, the term of this patent is extended or adjusted under 35 U.S.C. 154(b) by 0 days.

(21) Appl. No.: 18/083,525

(22) Filed: Dec. 18, 2022

(51) Int. Cl.
*A45F 5/02* (2006.01)

(52) U.S. Cl.
CPC ..... *A45F 5/021* (2013.01); *A45F 2200/0575* (2013.01)

(58) Field of Classification Search
CPC ..... A45F 5/021; A45F 2200/0575; A45F 2200/0566
USPC ..... 211/60.1, 69, 69.1, 69.5, 69.8, 70, 70.6, 211/89.01; 224/242, 245, 904, 271, 914, 224/935; 206/372; 248/314
See application file for complete search history.

(56) References Cited

U.S. PATENT DOCUMENTS 5,484,056 A * 1/1996 Wood ..... B65D 73/0064 206/349
6,321,961 B1 * 11/2001 McDaid ..... B62J 11/00 224/442
6,481,583 B1 * 11/2002 Black ..... B25H 3/04 211/89.01
6,702,112 B1 * 3/2004 Henderson ..... B65D 85/20 224/904
6,932,223 B1 * 8/2005 Lee ..... B25H 3/04 206/349
6,978,890 B2 * 12/2005 Pangerc ..... B25H 3/003 206/349
7,188,726 B2 * 3/2007 Lin ..... B25H 3/003 206/743
7,780,016 B1 * 8/2010 Cornwell ..... B25H 3/003 211/69
8,069,995 B2 * 12/2011 Winnard ..... B25H 3/003 211/89.01
8,651,348 B2 * 2/2014 Meng ..... B25H 3/003 206/743
8,911,103 B2 * 12/2014 Matthews ..... F21V 17/168 362/396
10,759,217 B2 * 9/2020 Black ..... A45F 5/021
11,583,060 B1 * 2/2023 Blauer ..... F41C 33/041
2009/0001111 A1 * 1/2009 Lin ..... B25H 3/003 224/245
2010/0308090 A1 * 12/2010 Lai ..... B25H 3/006 206/349
2013/0043201 A1 * 2/2013 Wang ..... B25H 3/003 211/70.6

(Continued)

*Primary Examiner* — Justin M Larson
(74) *Attorney, Agent, or Firm* — ARJOMAND LAW GROUP; Farija Majd

(57) ABSTRACT

A system and method are disclosed including a tool clip having a receptacle, and a matching receptacle sleeve to attach to an elongated hand tool, such as a screwdriver. In various embodiments, the receptacle has springs to lock and retain the sleeve and hand tool in the tool clip. In a locked state, the screwdriver is restricted from axial and radial movements. In some embodiments, the sleeve has notches or cavities to receive a spring tip or tooth for locking the tool. The springs may be of different types, made of plastic or metal, and may be a single piece or multiple pieces. The tool clip may further include belt clips, loops, or hangers of various sorts to attach the tool clip to a toolbelt worn by a user.

19 Claims, 5 Drawing Sheets

(56) References Cited

U.S. PATENT DOCUMENTS

2014/0091118 A1* 4/2014 Hsiao ..... A45F 5/021
224/242

* cited by examiner

LOCKING SCREWDRIVER HOLDER

TECHNICAL FIELD

This application relates generally to tool locks for securing tools, and more specifically to a spring-based screwdriver lock and holder.

BRIEF DESCRIPTION OF THE DRAWINGS

The drawings, when considered in connection with the following description, are presented for better understanding of the subject matter sought to be protected.[DO NOT change text spacing from the template!]

DETAILED DESCRIPTION

Figure 1:
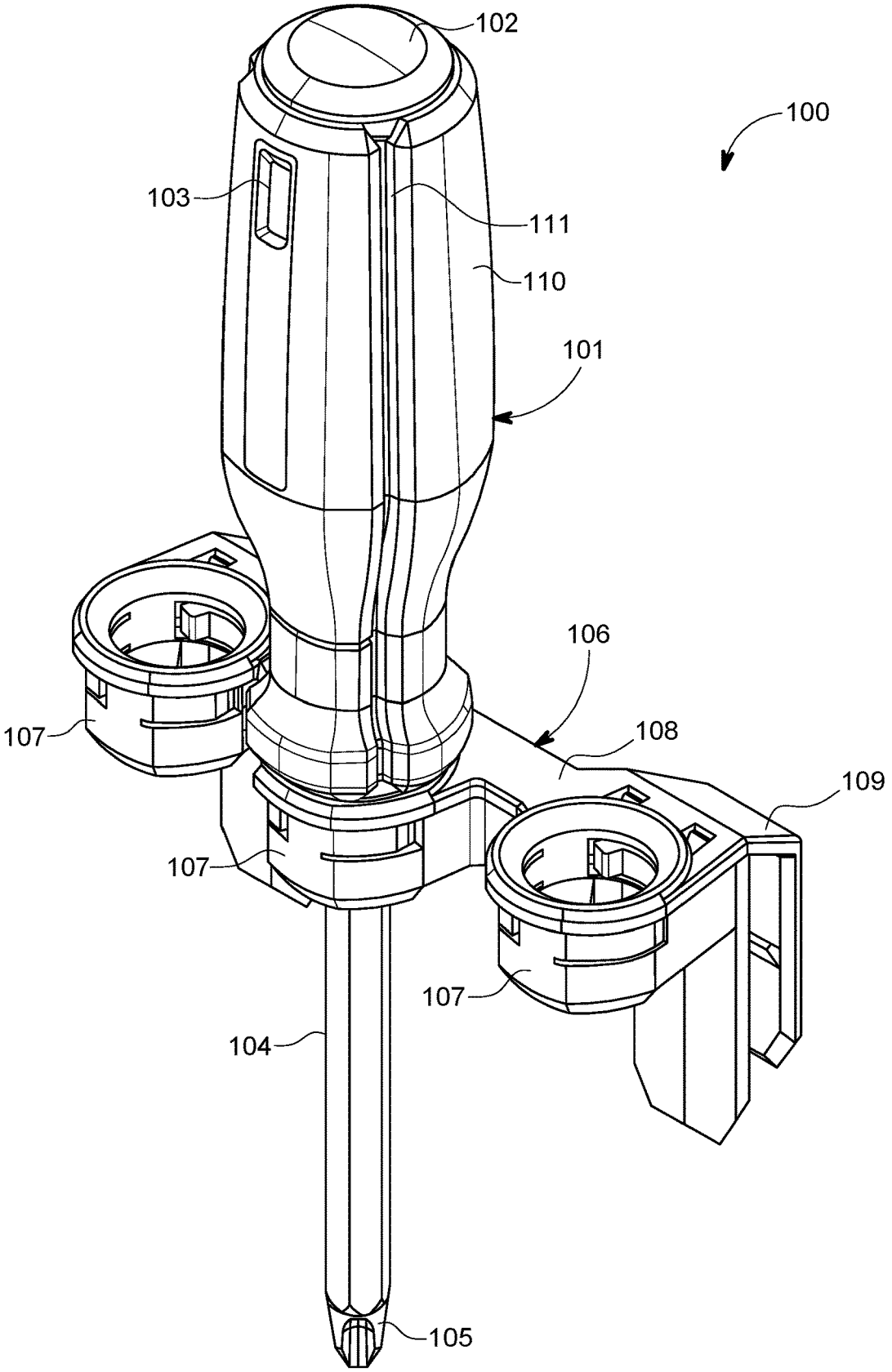
FIG. 1 shows an example screwdriver releasably secured to a tool clip with a sleeve.

While the present disclosure is described with reference to several illustrative embodiments and example devices described herein, it should be clear that the present disclosure should not be limited to such embodiments. Therefore, the description of the embodiments provided herein is illustrative of the present disclosure and should not limit the scope of the disclosure as claimed. In addition, while following description references screwdrivers and particular configurations of tool clip and sleeve, it will be appreciated that disclosure may be applicable to other tools and configurations of tool clip and sleeve such as hammers and crow bars or other elongated tools.

Briefly described, a system and method are disclosed including a tool clip having a receptacle, and a matching receptacle sleeve to attach to an elongated hand tool, such as a screwdriver. In various embodiments, the receptacle has springs to lock and retain the sleeve and hand tool in the tool clip. In a locked state, the screwdriver is restricted from axial and radial movements. In some embodiments, the sleeve has notches or cavities to receive a spring tip or tooth for locking the tool. The springs may be of different types, made of plastic or metal, and may be a single piece or multiple pieces. The tool clip may further include belt clips, loops, or hangers of various sorts to attach the tool clip to a toolbelt worn by a user.

In various embodiments, an elongated tool holding apparatus is disclosed that includes a tool clip having one or more receptacles, a matching sleeve to be received in the one or more receptacles, where the matching sleeve is coupled with the elongated tool. The matching sleeve to be locked within the one or more receptacles restricts a radial and axial movement of the elongated tool in the tool clip.

In various embodiments, a tool clip is disclosed that includes a frame, one or more receptacles coupled with the frame, the receptacles having one or more springs usable to lock a tool within the tool clip. The one or more springs enable locking the tool in cooperation with one or more notches deployed within a sleeve matched with the one or more receptacles.

In various embodiments, a method of locking an elongated tool is disclosed including coupling a sleeve with an elongated tool, the elongated tool having a longitudinal axis, inserting the elongated tool and the sleeve into a matching receptacle coupled with a tool clip, rotating the elongated tool about its longitudinal axis, and placing the sleeve into a locked position.

Building contractors, construction crews, private do-it-yourself (DIY) people, various manufacturing facilities, various repair shops such as auto shops, and the like, often use a variety of small hand tools such as screwdrivers. In most applications, more than one type and size of tool is used. For example, an application in which screwdrivers are used, such as assembling a part using nuts and bolts, several sizes and types of screwdrivers may be employed. For efficiency and ease of use, the user may desire to have the several screwdrivers readily available, for example, on a toolbelt. In some work environments, it is desirable to have the screwdrivers or other elongated hand tools, such as small crowbars, chisels, hole punches, awls, and the like, be securely attached to the toolbelt so they do not fall off when the user kneels or bends down to perform some tasks. As such, there is a need for a system and method to easily and securely insert and lock and also unlock and remove elongated hand tools from a toolbelt.

Most existing toolbelts have pouches, pockets, and loops to contain various tools and materials such as nails and screws. However, these pockets and loops are not as secure as sometimes needed and tools may fall out if the toolbelt is tilted downwards, such as when the user bends down.

It is to be noted that directions, orientations, and other relative terms such as "front", "back", "top", "bottom", "left", "right", "inside", "outside", "interior", "exterior", "downward", "upward", "front-facing", "down-facing", "vertical", "horizontal", "diagonal", and the like are described with respect or relative to a distinguishing feature of the system or device body itself. For example, if the front part or surface of a system body or an object is identified in the description, then rear or back is defined as the part or surface opposite the front surface, left is defined as the left side when looking into the front surface, and so on. As long as directions are unambiguously identifiable based on the descriptions and figures, how the orientations are defined is immaterial.

FIG. 1 shows an example screwdriver releasably secured to a tool clip with a sleeve. In various embodiments, tool arrangement 100 includes screwdriver 101 having a cap 102, a hole 103 for attaching a string or hanging on a nail or hook for storage, a shaft 104, a working tip 105, a handle 110, and an alignment groove 111. The tool arrangement 100 further includes tool clip 106 having one or more tool receptacles 107, a frame or body 108, and a belt mounting hook 109.

In various embodiments, the screwdriver includes a longitudinal axis that extends along the shaft 104. Typically, a width of the handle 103 exceeds a diameter of the shaft 104. The shaft may have a hexagonal cross-section to resist relative rotation of the screwdriver with respect to other items such as handle or sleeve. Other cross-sections, such as circular, oval, square, and the like may also be employed. The tool clip 106 is shown to have a main body or frame 108, and may have an attachment member, such as mounting hook 109, to secure the clip to a structure. The clip defines at least one receptacle 107, with each receptable having a receptacle axis which is aligned generally parallel with the screwdriver axis when the screwdriver is in the locked position. Typically, the shaft 104 of the screwdriver 101 extends through one of the receptacles 107 when the screwdriver is in the locked position. The tool clip 106 may advantageously be formed from a unitary or one-piece construction, and can be made of a resin via an injection molding process.

In various embodiments, in operation, the screwdriver 101 is inserted into the receptacle 107 and rotated into a locked state. In the locked state, the screwdriver 101 is prevented from moving along the longitudinal axis of the screwdriver 101, the axis being aligned or parallel with the shaft 104. In some embodiments, the rotation of the screwdriver 101 into the locked state is done automatically under the weight of the screwdriver or by pushing it down into the receptacle 107 along the longitudinal axis. In other embodiments, the rotation of the screwdriver 101 is effected by the user twisting it into the locked state. The screwdriver 101 may be unlocked by twisting it in the opposite direction by the user to allow lifting it up and out from the tool clip 106. The locking mechanism and the operation of the screwdriver 101 in the tool clip 106 are further described below.

Figure 2:
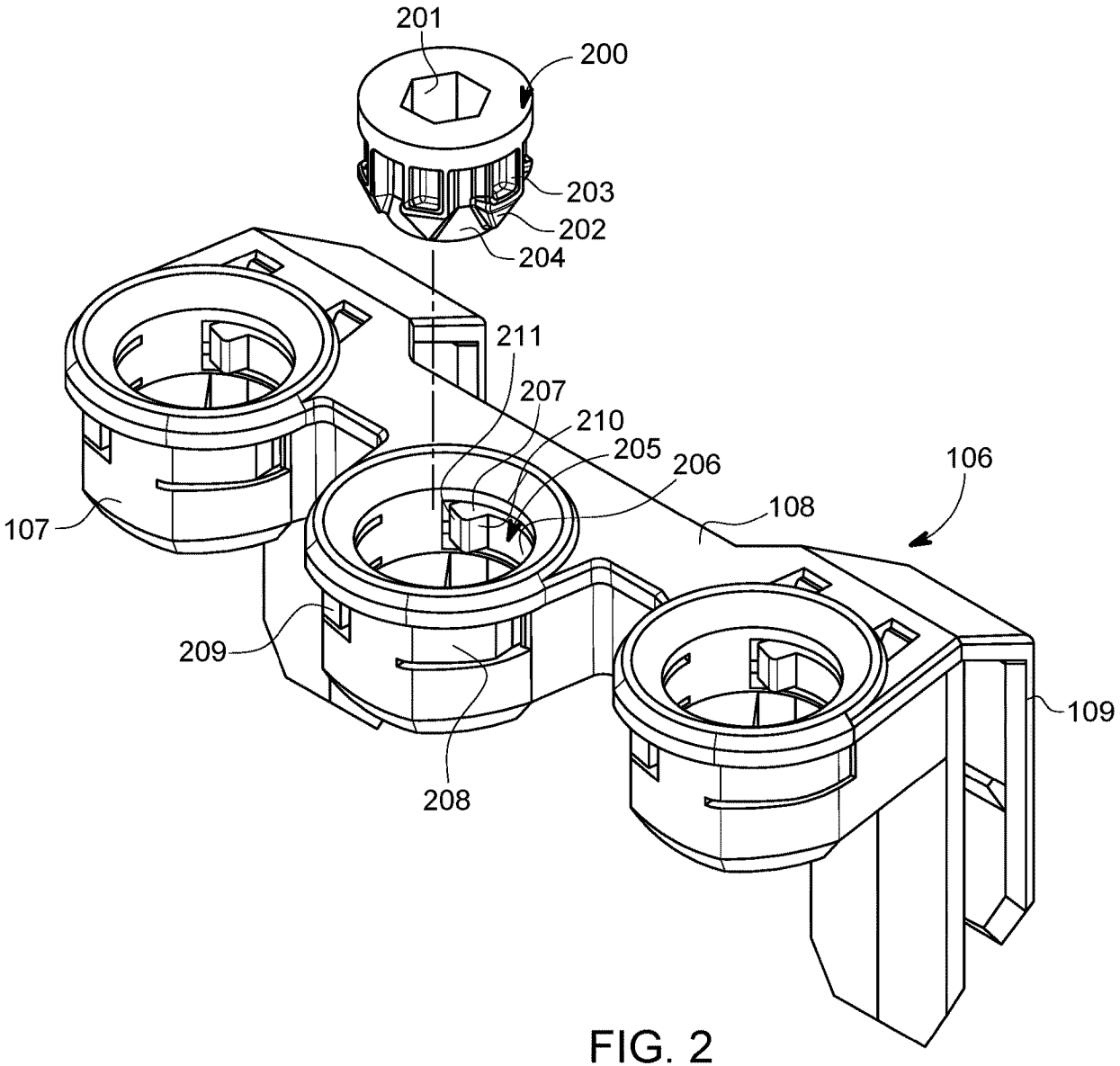
FIG. 2 shows an example exploded view of the arrangement of FIG. 1 showing the sleeve and the tool clip.

FIG. 2 shows an example exploded view of the arrangement of FIG. 1 showing the sleeve and the tool clip. In various embodiments, a matching insert or sleeve 200 having a shaft channel 201, a spring tip receiver 202, a notch 203, and a spring tip channel 204. The tool clip 106 includes receptacles 107, tool clip frame 108, belt clip or mounting hook 109, one or more cantilever springs 205, cantilever spring body 206, spring tooth or tips 207 and 209 (two different springs), spring base 208, spring tip first slanted face 210 facing towards spring body 206, and spring tip second slanted face 211 facing away from spring body 206.

In various embodiments, the sleeve 200 is designed and configured to match and fit in the receptacle 107 and may be in the form of a short cylinder, with internal and external surfaces, that is fitted onto a screwdriver (or other elongated tool) shaft and is used to lock it within the receptacle 107. The spring tip receiver 202 is structured to include a cavity (notch 203) to receive the spring tip 207. The spring tip channel 204 is formed between two adjacent spring tip receivers 202 to guide the spring tip 207 towards the notch 203 to come to rest in a locked state. The sleeve 200 has top and bottom openings that define an interior shaft channel 201 to receive (from the top) and circumferentially surround the shaft 104 of the screwdriver 101. The shaft 104 can slide through the shaft channel 201 by force to pressure-fit the shaft 104 to the receptacle 107. The assembling of the sleeve 200 onto the screwdriver 101 may be done by the user after manufacturing of the screwdriver. In these embodiments, the user may remove the sleeve 200 from the screwdriver 101 to be used with a different screwdriver or tool. Alternatively, the sleeve may be formed as a unitary extension of the handle 110, or can be affixed to the screwdriver via adhesive or a set screw built into the sleeve at manufacturing time.

In various embodiments, the lock spring 205 may be a cantilever spring made of plastic, metal, composite material, or the like. The function of the lock spring 205 or other types of suitable springs for this application is to provide tensioning force to enable locking the screwdriver 101 in the tool clip 106. The tensioning cantilever lock spring 205 includes the flexible body 206 that provides the spring force, and the spring base 208 that is the point of attachment to the receptacle 107 against which the spring force is exerted. The spring tip 207 creates the locked state when it falls into or inserted in notch 203. The spring tips' first and second slanted (angled) faces 210 and 211, respectively, are used to slide over matching slant surfaces deployed within the spring tip receiver 202 to allow the spring tip 207 to fall into notch 203, as further described with respect to FIG. 3 below. The two slant surfaces allow the cantilever lock spring 205 to flex away from the spring's resting position (away from center of receptacle 107) when pressed against the matching slant surfaces. In various embodiments, one or more cantilever springs 205 may be deployed within each receptacle 107. When the sleeve 200 is inserted into receptacle 107, the one or more tips 207 of the cantilever springs 205 will fit into as many notches 203 of the sleeve 200.

In various embodiments, the mounting hook 109 may be used as a belt hook to attach the tool clip 106 to a user's belt. In other embodiments, the mounting hook 109 may be replaced by a belt loop to allow attachment of the tool clip 106.

In various embodiments, the shaft 104 of the screwdriver may have a polygonal cross section to prevent slippage of the shaft in the sleeve. Other cross-sectional shapes, such as oval, rectangular, and the like may also be used for the same purpose.

In various embodiments, the tool clip 106 may be made of metal, plastic, composite, and the like. The tool clip 106 may also include one or more receptacles 107. Each receptacle 107 may hold one elongated tool.

Figure 3:
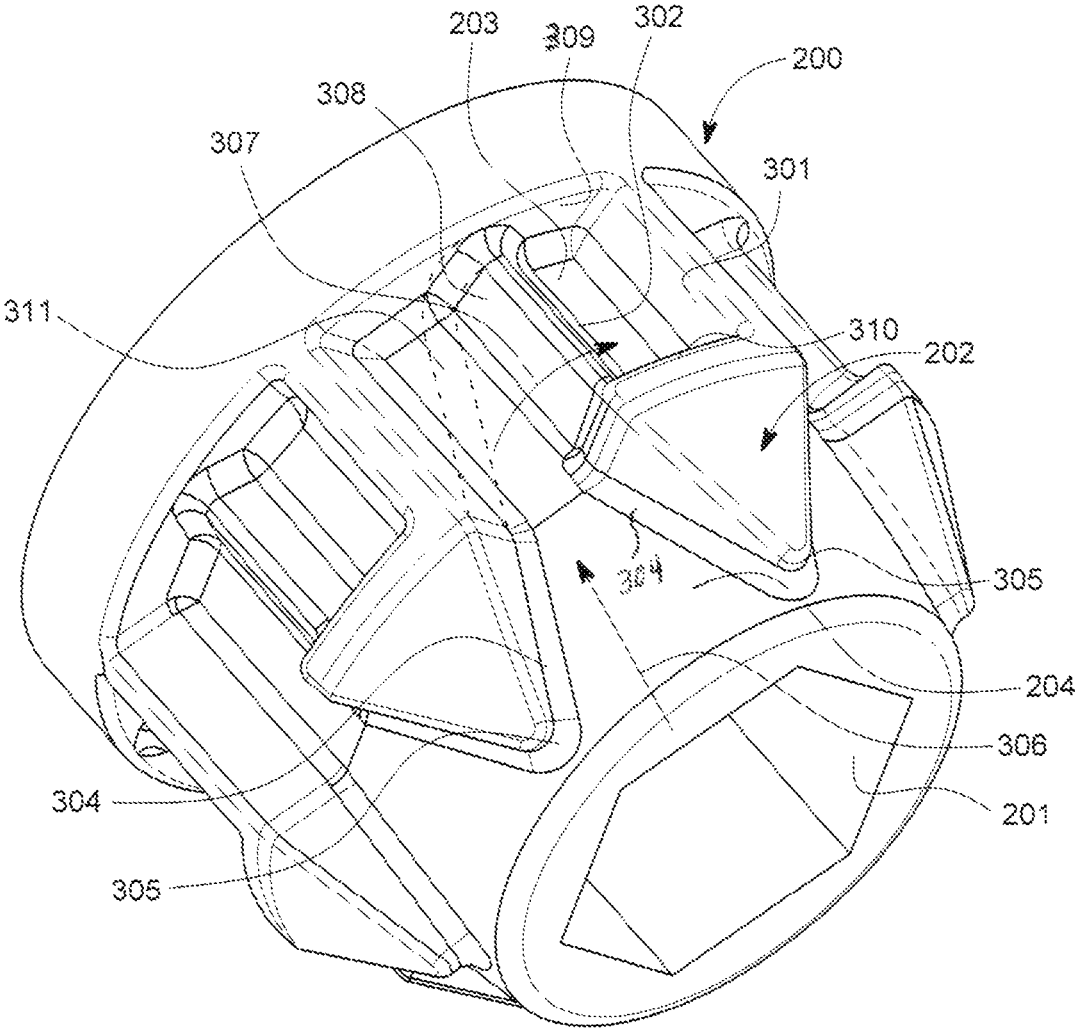
FIG. 3 shows an example sleeve of FIG. 2.

FIG. 3 shows an example tool clip sleeve of FIG. 2. In various embodiments, sleeve 200 includes shaft channel 201, spring tip receiver 202 having the notch 203, sprint tip channel 204, radial stop surface 301, notch wall 302, an upper axial stop surface 309, a lower axial stop surface 310, optional slanted or angled wall cam 311, spring tip channel walls 304, spring tip receiver front end 305, spring tip axial path 306, spring tip radial path 307, and spring tip lift surface 308.

In various embodiments, the sleeve 200 has a structure that includes multiple spring tip receivers 202 arranged circumferentially around the sleeve 200. Generally, the sleeve 200 is configured and made to match the interior design of the receptacle 107 as detailed below. Each pair of adjacent spring tip receivers form a spring tip channel 204 between them. More specifically, the spring tip channel walls 304 are exterior surfaces and parts of the two adjacent spring tip receivers 202, as shown in the figure. When the screwdriver 101 is inserted into receptacle 107, the spring tip 207 enters the spring tip channel 204, which is wider at the bottom of the sleeve 200 and narrower towards the top to guide the spring tip 207 into the notch 203. The notch wall 302 has two angled surfaces or wall faces on the exterior and the interior of the notch 203. The exterior angled surface is the lift surface 308 and is used as a ramp to lift the spring tip 207 leading it to the inner space of the notch 203 during the locking process, as further described below. The inner surface of notch wall 302 forms a radial stop surface, which also functions as a ramp or lift surface in the reverse direction for the spring tip 207. The walls at the top and bottom of the notch 203 function as axial stops for the spring tip 207.

The orientation and directions of the sleeve as described herein is with respect to the structure of the sleeve and the tool clip 106. The top of the sleeve 200 and its parts, such as notch 203, is where the shaft 104 enters the sleeve near axial stop surface 309, where the screwdriver handle 110 rests. The bottom of the sleeve 200 is near the front end 305 of the spring tip receiver 202, which is where the shaft exits the shaft channel 201 of sleeve 200. The axial direction is along the shaft 104, while the radial (rotational) direction is the radially perpendicular to and around the shaft 104.

In various embodiments, in operation, the shaft 104 is inserted into and coupled with the sleeve 200. The screw driver 101 and the sleeve 200 are inserted into the tool clip 106 by the user. The one or more spring tips 207 fall into one or more spring tip channels 204 and start moving up along the spring tip axial path 306. When the spring tip 207 reaches the top of the spring tip axial path 306, the user may twist the handle 110 of the screwdriver 101 in either clockwise (CW) and/or counterclockwise (CCW), depending on the design of the sleeve 200, at which time the spring tip 207 is pushed up the lift surface 308, in the direction of the radial path 307, and then fall into the notch 203's inner space. At this point the screwdriver is locked in place. In this locking process or operation, the cantilever lock spring 205 is flexed backwards (away from center of receptacle 107) when pushed up by the lift surface 308. It cannot move up or down because the axial stop surfaces 309 and 310 prevent its axial movement. The radial movement of the screwdriver is also prevented by the radial stop surfaces 301 and lift surface 308, which also functions as a radial stop surface. The spring tip 207 may be removed from the notch 203 by radial force applied by the user to lift up the spring tip 207 over the notch wall 302 and back into the spring tip channel 204. At this point, the spring tip 207 is free from the bottom axial stop surface 310 and the screwdriver 101 may be pulled up and removed from the tool clip 106 by the user.

In various embodiments, the spring tip angled faces 210 and 211 may have substantially the same angle as the lift surface 308 to smoothly engage one another during the lift operation of the spring tip 207 when locking or unlocking the screwdriver 101.

In various embodiments, the straight radial stop surfaces 301 and the slanted inner surface of notch wall 302 (slanted or angled with respect to a bottom surface of the notch 203, which is coplanar with external surface of the sleeve 200 cylinder) form radial stop surfaces. That is, the slanted surfaces form an angle greater than 90 degrees with respect to the bottom of the notch 203 (a straight wall is aligned with a radius of the sleeve 200 cylinder and at 90 degrees with respect to a tangent line at the point of contact). Under sufficient radial (rotational) force on the handle 110 of the screwdriver, the spring tip 207 may slide upwards (away from center of sleeve 200 cylinder) on the slant surfaces such as lift surface 308 or radial stop surface 301. When the lock spring 205 is in the locked position, rotation (radially around shaft 104) of the screwdriver handle 110 causes the sleeve 200 to be rotated with respect to the tool clip 106 with sufficient force overcomes the biasing force of the lock spring 205 against the sleeve and allows the sleeve to move out of the notch 203 to an unlocked position. Thus, the screwdriver 101 is held in place when in the locked position but can easily be removed by a user of the tool.

In various embodiments, the locking process may be partially automated under the weight of the screwdriver or by force exerted axially along the shaft 104, without rotating or twisting the screwdriver 101 by the user. Various mechanical techniques may be used to transform an axial force into rotational force, such as cylindrical cams, curved or angled surfaces guiding a protrusion, such as spring tip 207, in particular directions. For example, the angled and/or curved wall cam 311 (shown in dotted lines) functions as a mechanical cam component to push the spring tip 207 to the right along the direction of the radial path 307 (as shown in FIG. 3). This is partial automation because the user need not twist or rotate the screwdriver after insertion into the tool clip 106 to lock it in place. It is locked under vertical or axial force, such as a user's push downwards or the weight of the screwdriver itself.

In various embodiments, the walls surrounding and forming each notch 203 may be straight (90 degrees with respect to bottom surface of the notch 203), or slanted to limit the directions in which the sleeve 200 may rotate. For example, if the walls are angled as shown in FIG. 3, then the sleeve 200 may only rotate CCW (with the spring tip 207 moving in the opposite direction with respect to the sleeve 200). Specifically, the exterior of notch wall with radial stop surface 301 is straight in each spring tip receiver 202. So, the spring tip 207 may only enter and exit the notch 203 from notch wall 302, both sides of which are slanted. In embodiments that the notch walls are angled differently, the radial movements of the spring tip 207 are restricted accordingly and differently.

In various embodiments, the releasable snap fit connection between the sleeve 200 and tool clip 106 and its receptacles 107 may be reversed. Specifically, the position of the lock spring 205 and the notches 203 may be reversed, such that the cantilever springs 205 are deployed within the sleeve 200 (for example, optionally as a unitary extension of the sleeve 200 or coupled therewith as a separate part) and the corresponding notches 203 are formed on the receptacles 107 on the tool clip 106.

In various embodiments, the sleeve 200 may be integrated as one piece with the handle 110. In this embodiment, the sleeve 200 is not a separate piece and cannot be separated from the shaft 104 by the user. The sleeve may be built into the handle as part of the handle 110 attached to the shaft 104.

In other embodiments, the spring tip receivers 202 may be deployed or carved within a sufficiently thickened shaft 104 to perform the same functions of receiving the spring tips 207. In such embodiments, the notch 203, notch walls (e.g., lift surface 308, radial stop 301, front end 305, and other parts needed to perform the functions of the sleeve 200 as described herein.)

In the embodiments that have the sleeve 200 implemented as an integrated part, the operation of the lock remains substantially similar to the embodiments that have a separate and distinct sleeve 200, as described herein with respect to FIG. 3. In such embodiments, the structure of the spring tooth receivers 202, including the notch 203, lift surface 308, radial stop 301, front end 305, spring tip channel 204, channel sides 304, axial stop 309, and/or angled wall cam 311, and other related aspects and portions needed to perform the functions of the sleeve 200, remains similar, in structure and function, to those of sleeve 200 described with respect to FIG. 3. The aforementioned parts of the sleeve 200, excluding the cylindrical body of the sleeve 200 that hosts such structures, parts, and features, collectively form a lock receiver that is configured to receive the spring tip 207 and lock the screwdriver and the tool clip 106 together. As noted above, the places of the lock spring 205 and lock receiver (or sleeve 200 locking structures and parts) may be exchanged. Namely, the lock receiver may be placed within the tool clip 106, while the lock spring 205 is placed on the sleeve or shaft 104 or handle 110 of the screwdriver 101.

Figure 4B:
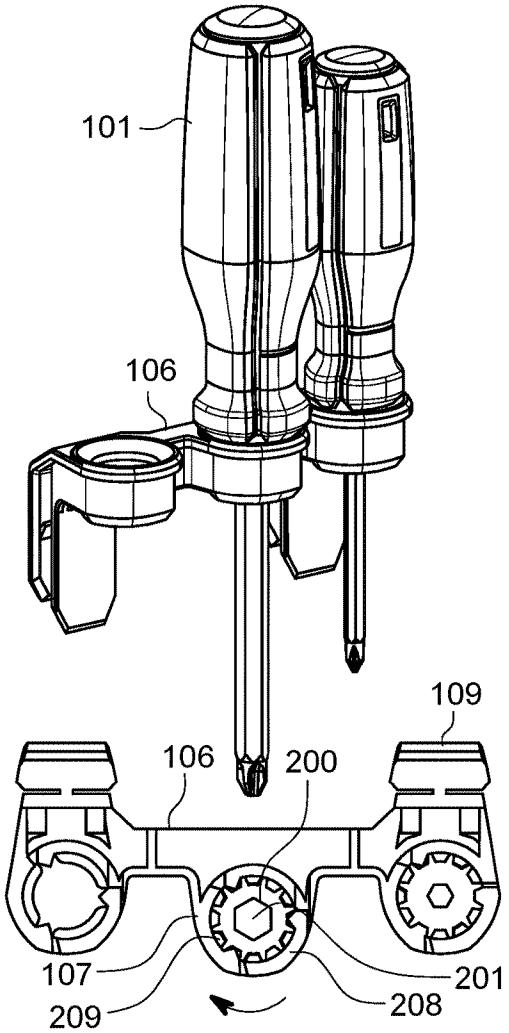
FIG. 4B shows another example view of screwdrivers of FIG. 4A inserted into the tool clip and rotated (along the arrow shown) to a locked position using the one or more cantilever spring.
Figure 4A:
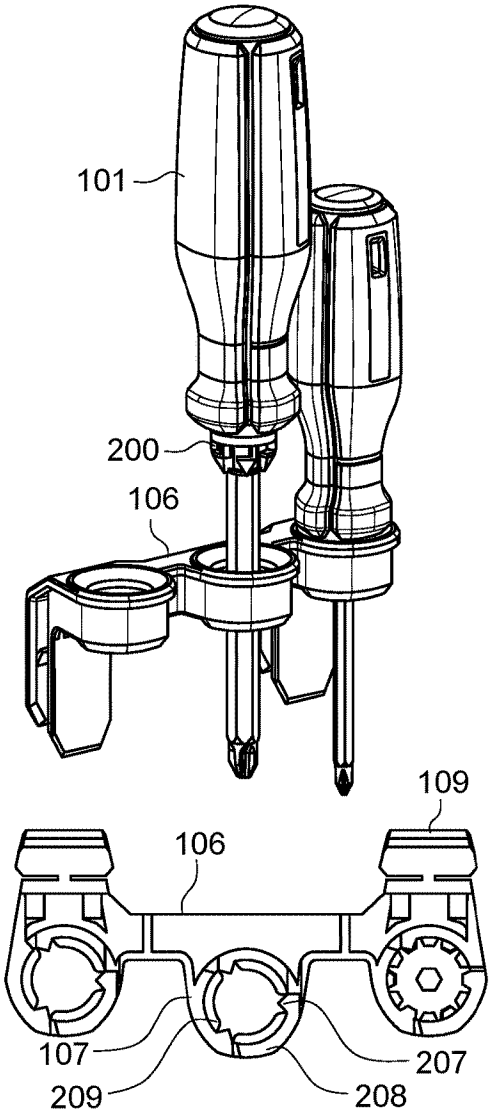
FIG. 4A shows an example view of screwdrivers inserted into the tool clip before being locked using one or more cantilever springs.

FIG. 4A shows an example view of screwdrivers inserted into the tool clip before being locked using one or more cantilever springs. In various embodiments, this arrangement shows a sideview of the screwdriver 101 having sleeve 200 coupled therewith, inserted half-way through tool clip 106. The arrangement further shows a top view of the tool clip 106 having belt mounting hooks 109, receptacle 107, spring base 208, and spring tips 207 and 209.

In various embodiments, the operation is as described above with respect to FIG. 3. FIG. 4A shows a first phase of the operation where the screwdriver 101 is first inserted into receptacle 107 but not fully inserted or locked yet. In this figure, two screwdrivers 101 and three receptacles 107 are shown. The receptacle 107 on the right side shows a screwdriver as fully inserted and locked, while the receptacle 107 in the middle shows a screwdriver in the process of being inserted. The top view of the tool clip 106 shows the cross section of each of the receptacles 107 at the top with the middle receptacle 107 not yet engaged with sleeve 200 of the respective screwdriver 101, while the right receptacle 107 shows the sleeve 200 being fully engaged and enclosed by the receptacle 107 and locked in position.

In various embodiments, each cantilever lock spring 205 (see FIG. 2) is equally circumferentially separated from one another about the screwdriver shaft 104 axis (about 120 degrees apart around the screwdriver axis for three springs). Sleeve 200 has three equally circumferentially spaced notches 203 that is coupled with the screwdriver 101, and FIG. 4A shows one screwdriver/sleeve about to be inserted into the middle receptacle 107 of the tool clip 106. The notches 203 within a given receptacle 107 on the sleeve 200 need not be aligned with the spring tips 207. The tool/sleeve rotationally travel along the screwdriver axis within the receptacle 107 until the spring tip 207 falls into one of the spring tip channels 204 in the sleeve 200 restricting additional movement of the spring tip 207 with respect to the sleeve 200. From there, the tool/sleeve can be moved to one of the three locked positions with a twist in either a clockwise or counterclockwise direction about the screwdriver axis.

FIG. 4B shows another example view of screwdrivers of FIG. 4A inserted into the tool clip and rotated (along the arrow shown) to a locked position using the one or more cantilever spring. In various embodiments, this arrangement shows a sideview of the screwdriver 101 coupled with sleeve 200 and fully inserted through tool clip 106. The arrangement further shows a top view of the tool clip 106 having belt mounting hooks 109, receptacle 107, shaft channel 201 enclosing shaft 104, spring base 208, and spring tip 209.

In various embodiments, this arrangement shows the second phase of locking the screwdriver 101 within the tool clip 106. As noted above, once the screwdriver 101 is inserted into receptacle 107, it may rotate (either automatically or manually by the user) and enter a locked position.

In various embodiments, the operation is as described above with respect to FIG. 3. FIG. 4B shows the second phase of the operation where the screwdriver 101 has already been fully inserted into receptacle 107 and is locked. In this figure, two screwdrivers 101 and three receptacles 107 are shown. The receptacles 107 on the right side and the middle show two screwdriver that are fully inserted and locked. The top view of the tool clip 106 shows the cross section of each of the receptacles 107 at the top with both being engaged with sleeve 200 of the respective screwdriver 101.

In various embodiments, the unlocking process for the screwdriver 101 out of the tool clip 106 is the reverse of the locking process described above with respect to FIGS. 3 and 4A. Specifically, the user may rotate the screwdriver 101, along with the sleeve 200 coupled with it, in the opposite direction of the locking process, and pull the screwdriver 101 out of receptacle 107.

Figure 5B:
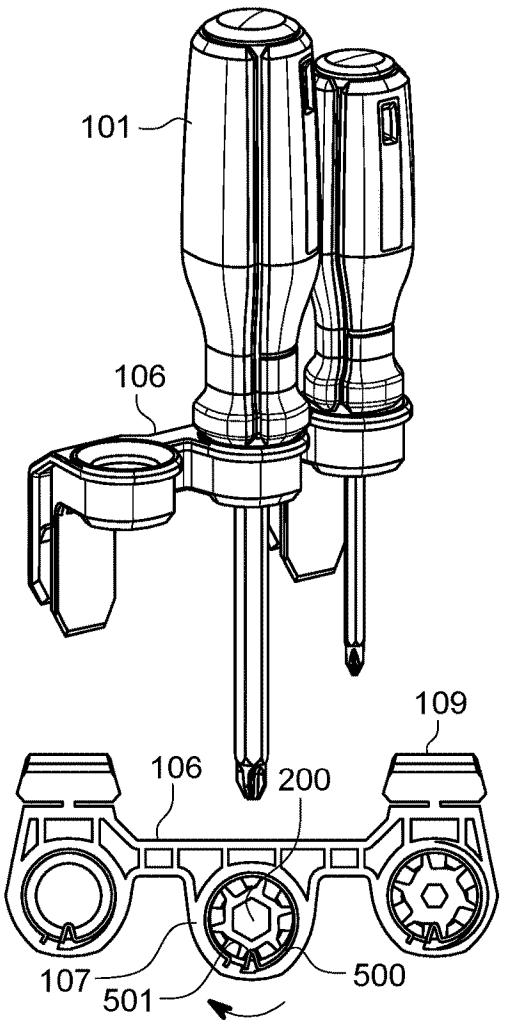
FIG. 5B shows another example view of screwdrivers of FIG. 5A inserted into the tool clip and rotated to a locked position using the ring or flange spring.
Figure 5A:
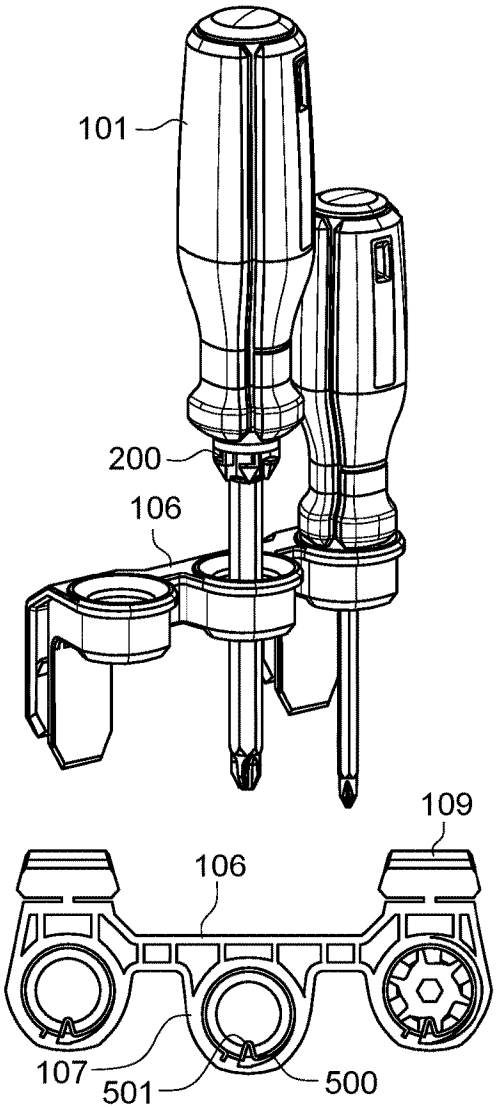
FIG. 5A shows an example view of screwdrivers inserted into the tool clip before being locked using a ring or flange spring.

FIG. 5A shows an example view of screwdrivers inserted into the tool clip before being locked using a ring or flange spring. In various embodiments, this arrangement shows a sideview of the screwdriver 101 having sleeve 200 coupled therewith, inserted half-way through tool clip 106. The arrangement further shows a top view of the tool clip 106 having belt mounting hooks 109, receptacle 107, ring spring 500, and ring spring tip 501.

In various embodiments, the operation is substantially similar in material aspects as described with respect to FIGS. 3 and 4A above. The spring used to lock the screwdriver 101 in receptacle 107 may be different, using a ring or flange spring 500 having a single ring spring tip 501 that is locked into the notch 203 of the sleeve 200, in a similar way as described above with respect to FIG. 3 for lock spring 205. Specifically, the screwdriver 101 is gently rotated about its axis until the ring spring tip 501 falls into spring tip channel 204, guided through paths 306 and 307, and enters the notch 203 internal space, where the spring is locked in place as described above. The unlocking process is also similar to that described above with respect to FIG. 4B.

In various embodiments, the ring spring 500 is anchored at an anchor point around the perimeter of the receptacle 107 and the ring spring tip 501 is bent into the shape of a pointed equilateral fork, like the tip of a triangle. The ring spring tip 501 functions the same way as the spring tip 207 with respect to the sleeve 200 and notch 203. The ring spring 500 flexes by pushing against its anchor point in the perimeter of the receptacle 107. When the ring spring tip 501 is pushed out, away from center of receptacle 107, it flexes and pushes back towards the center of the receptacle 107, thus requiring radial force to overcome its spring force to lock and unlock it from the notch 203, going over angled lift surface 308 and inner angled surface of wall 302 (see FIG. 3).

FIG. 5B shows another example view of screwdrivers of FIG. 5A inserted into the tool clip and rotated to a locked position using the ring or flange spring. In various embodiments, this arrangement shows a sideview of the screwdriver 101 having sleeve 200 coupled therewith, inserted half-way through tool clip 106. The arrangement further shows a top view of the tool clip 106 having belt mounting hooks 109, receptacle 107, ring spring 500, and ring spring tip 501.

In various embodiments, similar to FIG. 4B, but with a different spring type, this arrangement shows the second phase of locking the screwdriver 101 within the tool clip 106. As noted above, once the screwdriver 101 is inserted into receptacle 107, it may rotate (either automatically or manually by the user) and enter a locked position.

In various embodiments, the operation is as described above with respect to FIG. 3. FIG. 5B shows the second phase of the operation where the screwdriver 101 has already been fully inserted into receptacle 107 and is locked. In this figure, two screwdrivers 101 and three receptacles 107 are shown. The receptacles 107 on the right side and the middle show two screwdriver that are fully inserted and locked. The top view of the tool clip 106 shows the cross section of each of the receptacles 107 at the top with both being engaged with sleeve 200 of the respective screwdriver 101.

In various embodiments, the unlocking process for the screwdriver 101 out of the tool clip 106 is the reverse of the locking process described above with respect to FIGS. 3 and 4A. Specifically, the user may rotate the screwdriver 101, along with the sleeve 200 coupled with it, in the opposite direction of the locking process, and pull the screwdriver 101 out of receptacle 107.

Changes can be made to the claimed invention in light of the above Detailed Description. While the above description details certain embodiments of the invention and describes the best mode contemplated, no matter how detailed the above appears in text, the claimed invention can be practiced in many ways. Details of the system may vary considerably in its implementation details, while still being encompassed by the claimed invention disclosed herein. Particular terminology used when describing certain features or aspects of the disclosure should not be taken to imply that the terminology is being redefined herein to be restricted to any specific characteristics, features, or aspects of the disclosure with which that terminology is associated. In general, the terms used in the following claims should not be construed to limit the claimed invention to the specific embodiments disclosed in the specification, unless the above Detailed Description section explicitly defines such terms. Accordingly, the actual scope of the claimed invention encompasses not only the disclosed embodiments, but also all equivalent ways of practicing or implementing the claimed invention.

It will be understood by those within the art that, in general, terms used herein, and especially in the appended claims (e.g., bodies of the appended claims) are generally intended as "open" terms (e.g., the term "including" should be interpreted as "including but not limited to," the term "having" should be interpreted as "having at least," the term "includes" should be interpreted as "includes but is not limited to," etc.). It will be further understood by those within the art that if a specific number of an introduced claim recitation is intended, such an intent will be explicitly recited in the claim, and in the absence of such recitation no such intent is present. For example, as an aid to understanding, the following appended claims may contain usage of the introductory phrases "at least one" and "one or more" to introduce claim recitations. However, the use of such phrases should not be construed to imply that the introduction of a claim recitation by the indefinite articles "a" or "an" limits any particular claim containing such introduced claim recitation to inventions containing only one such recitation, even when the same claim includes the introductory phrases "one or more" or "at least one" and indefinite articles such as "a" or "an" (e.g., "a" and/or "an" should typically be interpreted to mean "at least one" or "one or more"); the same holds true for the use of definite articles used to introduce claim recitations. In addition, even if a specific number of an introduced claim recitation is explicitly recited, those skilled in the art will recognize that such recitation should typically be interpreted to mean at least the recited number (e.g., the bare recitation of "two recitations," without other modifiers, typically means at least two recitations, or two or more recitations). Furthermore, in those instances where a convention analogous to "at least one of A, B, and C, etc." is used, in general such a construction is intended in the sense one having skill in the art would understand the convention (e.g., "a system having at least one of A, B, and C" would include but not be limited to systems that have A alone, B alone, C alone, A and B together, A and C together, B and C together, and/or A, B, and C together, etc.). In those instances where a convention analogous to "at least one of A, B, or C, etc." is used, in general such a construction is intended in the sense one having skill in the art would understand the convention (e.g., "a system having at least one of A, B, or C" would include but not be limited to systems that have A alone, B alone, C alone, A and B together, A and C together, B and C together, and/or A, B, and C together, etc.). It will be further understood by those within the art that virtually any disjunctive word and/or phrase presenting two or more alternative terms, whether in the description, claims, or drawings, should be understood to contemplate the possibilities of including one of the terms, either of the terms, or both terms. For example, the phrase "A or B" will be understood to include the possibilities of "A" or "B" or "A and B." It is further understood that any phrase of the form "A/B" shall mean any one of "A", "B", "A or B", or "A and B". This construct includes the phrase "and/or" itself.

The above specification, examples, and data provide a complete description of the manufacture and use of the claimed invention. Since many embodiments of the claimed invention can be made without departing from the spirit and scope of the disclosure, the invention resides in the claims hereinafter appended. It is further understood that this disclosure is not limited to the disclosed embodiments, but is intended to cover various arrangements included within the spirit and scope of the broadest interpretation so as to encompass all such modifications and equivalent arrangements.

What is claimed is:

1. An apparatus for holding an elongated tool, the apparatus comprising:

a tool clip having one or more receptacles;

a matching lock receiver to receive a lock spring tip in the one or more receptacles, the matching lock receiver having a notch with an angled surface to function as a ramp to lift or lower a sliding component, and wherein the matching lock receiver is coupled with the elongated tool; and wherein the matching receiver is to be locked together with one of the one or more receptacles to restrict a radial and axial movement of the elongated tool in the tool clip.

2. The apparatus of claim 1, wherein the one or more receptacles include one or more tensioning springs to enable locking the elongated tool.

3. The apparatus of claim 2, wherein the one or more tensioning springs comprise cantilever springs.

4. The apparatus of claim 2, wherein the one or more tensioning springs each include a spring base and a spring tip.

5. The apparatus of claim 4, wherein the matching lock receiver includes one or more spring tip receivers.

6. The apparatus of claim 5, wherein the notch of the one or more spring tip receivers is formed by one or more angled surfaces surrounding the notch.

7. The apparatus of claim 6, wherein the spring tips of the one or more tensioning springs are lifted by the one or more angled surfaces when the matching lock receiver is rotated in a predetermined rotational direction.

8. The apparatus of claim 7 wherein the spring tip has at least one slanted face.

9. The apparatus of claim 7, wherein the matching lock receiver is built into a cylindrical sleeve and has at least one spring tip channel that guides the spring tip to the notch to lock the elongated tool in the tool clip.

10. A tool clip comprising:

a frame;

one or more receptacles coupled with the frame, wherein the receptacles include one or more springs usable to lock a tool within the tool clip; and wherein the one or more springs enable locking the tool in cooperation with one or more notches deployed within a sleeve matched with the one or more receptacles, the one or more notches having one or more angled surfaces to function as ramps to lift or lower a sliding component.

11. The tool clip of claim 10, further comprising a mounting hook to attach the tool clip to a toolbelt.

12. The tool clip of claim 10, wherein the one or more receptacles have a cylindrical shape to receive the sleeve.

13. The tool clip of claim 12, wherein the sleeve has a shaft channel to receive an elongated tool.

14. The tool clip of claim 10, wherein the one or more springs each include a spring tip.

15. The tool clip of claim 14, wherein the spring tip is inserted into one of the one or more notches deployed within the sleeve to lock the elongated tool within the tool clip.

16. A method of locking an elongated tool, the method comprising:

coupling a sleeve with an elongated tool, wherein the elongated tool has a longitudinal axis;

inserting the elongated tool and the sleeve into a matching receptacle coupled with a tool clip, the sleeve having a notch with an angled surface to function as a ramp to lift or lower a sliding component;

rotating the elongated tool about its longitudinal axis; and placing the sleeve into a locked position.

17. The method of claim 16, wherein coupling the sleeve with the elongated tool comprises coupling the sleeve having a shaft channel with a polygonal cross-section by passing the elongated tool through the shaft channel.

18. The method of claim 16, wherein the angled surface of the notch functions as a ramp to lift a spring tip of a tensioning spring of the matching receptacle to place the sleeve into the locked position.

19. The method of claim 18, wherein the tensioning spring of the matching receptacle is one of a cantilever spring and a ring spring.

* * * * *